US010497533B2

(12) United States Patent
Yanagisawa

(10) Patent No.: US 10,497,533 B2
(45) Date of Patent: Dec. 3, 2019

(54) X-RAY GENERATING TUBE INCLUDING ELECTRON GUN, X-RAY GENERATING APPARATUS AND RADIOGRAPHY SYSTEM

(71) Applicant: CANON KABUSHIKI KAISHA, Tokyo (JP)

(72) Inventor: Yoshihiro Yanagisawa, Fujisawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 471 days.

(21) Appl. No.: 15/432,272

(22) Filed: Feb. 14, 2017

(65) Prior Publication Data

US 2017/0287668 A1 Oct. 5, 2017

(30) Foreign Application Priority Data

Mar. 30, 2016 (JP) ..... 2016-067013

(51) Int. Cl.

| | |
|---|---|
| ***H01J 35/00*** | (2006.01) |
| ***H01J 35/04*** | (2006.01) |
| ***H01J 35/06*** | (2006.01) |
| ***H01J 35/08*** | (2006.01) |
| ***H05G 1/30*** | (2006.01) |

(52) U.S. Cl.

CPC ..... *H01J 35/045* (2013.01); *H01J 35/06* (2013.01); *H01J 35/08* (2013.01); *H05G 1/30* (2013.01); *H01J 35/116* (2019.05); *H01J 2235/1258* (2013.01)

(58) Field of Classification Search

CPC ..... H01J 35/045

See application file for complete search history.

(56) References Cited

U.S. PATENT DOCUMENTS

| | | | | |
|---|---|---|---|---|
| 9,401,259 | B2 | 7/2016 | Ukiyo et al. | |
| 2014/0254755 | A1* | 9/2014 | Tsujino ..... | H01J 35/045 378/62 |
| 2016/0225572 | A1 | 8/2016 | Yanagisawa et al. | |

FOREIGN PATENT DOCUMENTS

| | | | |
|---|---|---|---|
| JP | 58-123643 | A | 7/1983 |

* cited by examiner

*Primary Examiner* — Dani Fox

(74) *Attorney, Agent, or Firm* — Venable LLP

(57) ABSTRACT

Provided is an X-ray generating tube including an electron gun, which includes a grid electrode secured to a support member. In the X-ray generating tube, thermal stress generated at a joining portion between the support member and the grid electrode is reduced, to thereby maintain a position of an electron beam on a target irradiated with the electron beam accurately for a long time. A grid electrode and a support member are secured to each other via a buffer member, which has an elastic coefficient that is lower than elastic coefficients of the grid electrode and the support member, and which is joined to the grid electrode and the support member through a first joining portion on the grid electrode side and a second joining portion on the support member side, respectively.

20 Claims, 4 Drawing Sheets

X-RAY GENERATING TUBE INCLUDING ELECTRON GUN, X-RAY GENERATING APPARATUS AND RADIOGRAPHY SYSTEM

BACKGROUND OF THE INVENTION

Field of the Invention

The present invention relates to an X-ray generating tube including an electron gun, which is applicable to medical equipment, a nondestructive inspection apparatus, and other such apparatus, an X-ray generating apparatus and a radiography system using the X-ray generating tube.

Description of the Related Art

Imaging systems utilizing material permeability of an X-ray are widely used for medical, industrial, and other such purposes. In a radiography system, an X-ray generating tube, which is configured to generate an X-ray, has the structure in which an anode and a cathode, which are used to apply a tube voltage, are opposed to each other via an insulating tube. The inside of the insulating tube is in a vacuum state. The cathode includes an electron gun configured to radiate an electron ray, and the anode includes a target configured to generate an X-ray by being irradiated with the electron ray. The electron gun includes an electron emitting portion and a grid electrode, and the target is irradiated with an electron beam, which is formed of electrons emitted from the electron emitting portion, in a spot shape through control of a locus by the grid electrode and a tube voltage applied between the cathode and the anode. The grid electrode is joined to one end of a support member, which extends in a tube axis direction of the X-ray generating tube, and another end of the support member is arranged in the cathode, which forms a part of an envelope of the X-ray generating tube.

As disclosed in Japanese Patent Application Laid-Open No. S58-123643, in a related-art X-ray generating tube, a grid electrode and a support member are joined to each other by welding.

In the X-ray generating tube, the electron emitting portion is heated when being driven. Therefore, heat is transferred also to the grid electrode and the support member near the electron emitting portion to cause thermal expansion, and thermal stress resulting from a difference in coefficient of thermal expansion between the grid electrode and the support member is applied to a joining portion between the grid electrode and the support member. Therefore, when the X-ray generating tube is used for a long time, the thermal stress is repeatedly applied to the joining portion between the grid electrode and the support member, and there has been a fear that the joining portion may be disconnected. When the joining portion is disconnected, there is a fear that a position at which the grid electrode is mounted to the support member may vary to shift the locus of the electron beam from a desired position, to thereby shift the position of the electron beam on the target irradiated with the electron beam.

SUMMARY OF THE INVENTION

It is an object of the present invention to reduce, in an X-ray generating tube including an electron gun, which includes a grid electrode secured to a support member, thermal stress generated at a joining portion between the support member and the grid electrode, to thereby maintain a position of an electron beam on a target irradiated with the electron beam accurately for a long time. It is another object of the present invention to provide a radiography system, which includes the X-ray generating tube and has excellent durability.

According to a first embodiment of the present invention, there is provided an X-ray generating tube including an electron gun, the electron gun including: a grid electrode; a support member configured to support the grid electrode; and a buffer member having an elastic coefficient that is lower than each elastic coefficient of the grid electrode and the support member, wherein the grid electrode and the buffer member are joined to each other to form a first joining portion, and the support member and the buffer member are joined to each other to form a second joining portion, and wherein the grid electrode and the support member are secured to each other via the first joining portion and the second joining portion.

According to a second embodiment of the present invention, there is provided a radiography system, including the above-mentioned X-ray generating tube according to the first embodiment of the present invention.

Further features of the present invention will become apparent from the following description of exemplary embodiments with reference to the attached drawings.

DESCRIPTION OF THE EMBODIMENTS

Preferred embodiments of the present invention will now be described in detail below in accordance with the accompanying drawings. However, the present invention is not limited to the embodiments to be described below. In the present invention, embodiments obtained by, for example, appropriately changing or modifying the embodiments to be described below based on the ordinary knowledge of a person skilled in the art so that such change or modification may not deviate from the gist thereof are also included in the scope of the present invention.

Figure 1A:
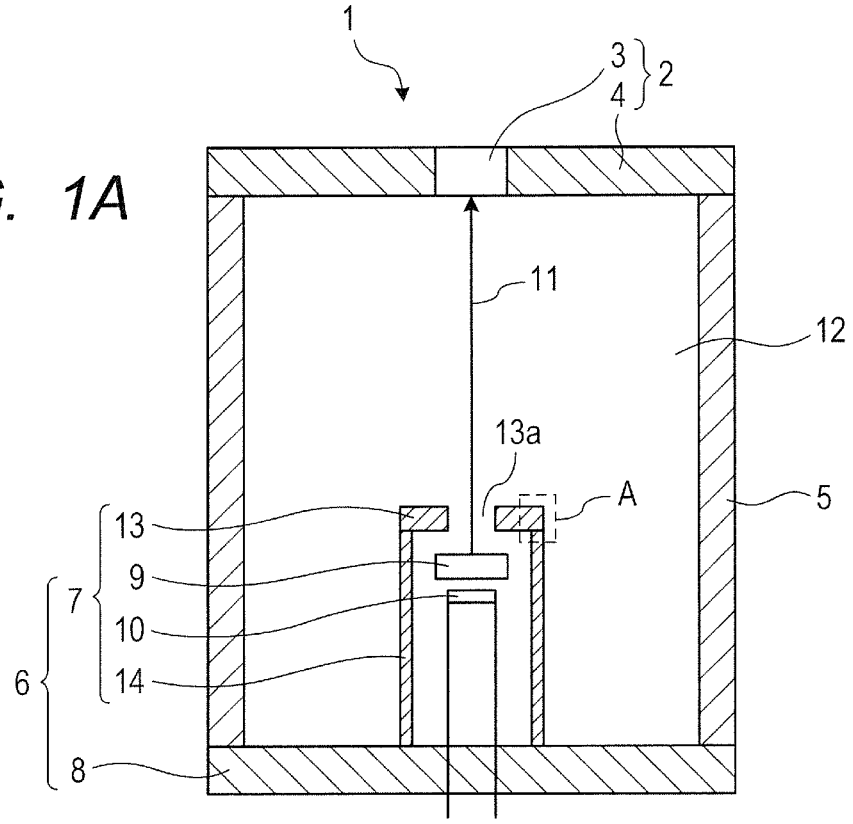
FIG. 1A and FIG. 1B are a cross-sectional view and a partially enlarged view for schematically illustrating the structure of an X-ray generating tube according to an embodiment of the present invention, respectively.
Figure 1B:
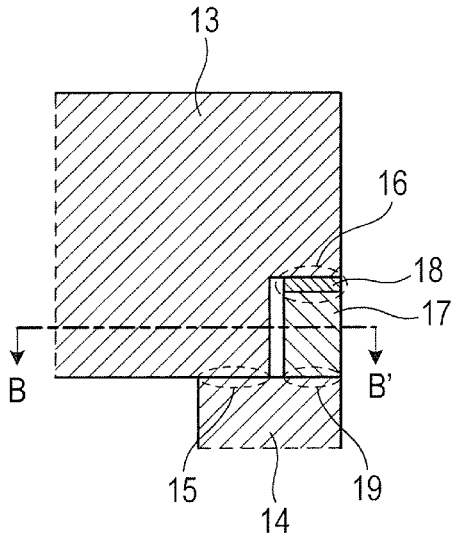

FIG. 1A is a cross-sectional view for schematically illustrating the structure of an X-ray generating tube according to an embodiment of the present invention, which is taken parallel to a tube axis direction of an X-ray generating tube 1. Moreover, FIG. 1B is an enlarged view of a region A enclosed by the broken line in FIG. 1A. In the following description, the term "tube axis" means a tube axis of the X-ray generating tube 1.

In the X-ray generating tube 1, an anode 2 and a cathode 6 are arranged to be opposed to each other via an insulating tube 5. The anode 2 at least includes a target 3 and an anode member 4, and the cathode 6 at least includes a cylindrical electron gun 7 and a cathode member 8. The X-ray generating tube 1 is configured to irradiate the target 3 with an electron beam 11 emitted from the electron gun 7 to generate an X-ray. In other words, the target 3 is provided in the X-ray generating tube 1 and is configured to generate an X-ray in response to electron irradiation. Therefore, the target 3 and the electron gun 7 are arranged to be opposed to each other. Electrons contained in the electron beam 11 are accelerated to incident energy required to generate the X-ray at the target 3 by an acceleration electric field formed in an inner space 12, which is sandwiched by the anode 2 and the cathode 6, of the X-ray generating tube 1.

The inner space 12 of the X-ray generating tube 1 is vacuum for securing a mean free path of the electron beam 11. A pressure inside the X-ray generating tube 1 is preferably $1\times10^{-4}$ Pa or less, and more preferably $1\times10^{-6}$ Pa or less from the viewpoint of life of an electron emitting portion 9. In order to achieve the pressure, there may be used a method involving using an exhaust pipe and a vacuum pump (not shown) to evacuate the inside of the X-ray generating tube 1 through the exhaust pipe in advance, and then sealing the exhaust pipe. In order to maintain a degree of vacuum inside the X-ray generating tube 1, a getter (not shown) may be arranged inside the X-ray generating tube 1. As the getter, there may be applied, for example, a getter of a non-evaporable type, which adsorbs gas components inside the X-ray generating tube 1 after activation through heating, or a getter of an evaporable type, which adsorbs gas to an active metal deposition surface formed by heating and evaporating a metal, for example, titanium.

The anode 2 of the X-ray generating tube 1 functions as an electrode, which defines an anode potential. The anode member 4 is made of a conductive material, and is electrically connected to the target 3. Moreover, as the anode member 4, a metal, such as copper, iron, tungsten, or kovar (trade name: Kovar, Westinghouse Electric Corporation), may be used, and the anode member 4 is joined to the insulating tube 5 with a brazing filler metal or the like. When the insulating tube 5 is made of a ceramic, kovar, which has a coefficient of thermal expansion that is close to that of the ceramic, may be suitably used as the anode member 4.

The target 3 made of a heavy metal, for example, tungsten, includes a target layer (not shown) and a support substrate (not shown), and is arranged so that the target layer faces the electron gun 7 side. The target layer is configured to generate an X-ray when being irradiated with the electron beam 11, and the support substrate is configured to hold the target layer. The target 3 serves as a transmissive window for extracting the X-ray, which is generated from the target layer, out of the X-ray generating tube 1, and forms a part of a circumferential wall of the X-ray generating tube 1 for maintaining the vacuum of the inner space 12 of the X-ray generating tube 1.

The cathode 6 of the X-ray generating tube 1 functions as an electrode, which defines a cathode potential. As the cathode member 8, a metal, such as copper, iron, tungsten, or kovar, may be used, and the cathode member 8 is joined to the insulating tube 5 with a brazing filler metal or the like. When the insulating tube 5 is made of a ceramic, kovar, which has a coefficient of thermal expansion that is close to that of the ceramic, may be suitably used as the cathode member 8.

The insulating tube 5 is arranged to electrically insulate the cathode 6, which is defined as the cathode potential of the X-ray generating tube 1, and the anode 2, which is defined as the anode potential. The insulating tube 5 is made of an insulating material, for example, a glass material or a ceramic material, and alumina is preferably used for processability, the cost, and other such factors.

The electron gun 7 includes the electron emitting portion 9, a cathode heater 10, a cylindrical grid electrode 13, and a cylindrical support member 14. The cathode heater 10 is a member configured to heat the electron emitting portion 9, and from the electron emitting portion 9 heated by the cathode heater 10, electrons are extracted with a predetermined voltage applied to the grid electrode 13 from a power supply (not shown). The extracted electrons are accelerated to the incident energy required to generate the X-ray at the target 3 by a voltage applied between the cathode 6 and the anode 2. As the electron emitting portion 9, there is suitably used, for example, an indirectly heated electron source, in which an impregnated electron source, which is formed by impregnating tungsten with barium, is heated with the cathode heater 10 to extract the electrons, or a directly heated electron source, in which a tungsten filament itself serves as an electron emitting portion.

The grid electrode 13 in the present invention is a cylindrical member including a passage hole 13*a*, through which electrons pass, at its center, has a function of extracting the electrons from the electron emitting portion 9, and hence may be used for on/off control of the irradiation with the X-ray by the X-ray generating tube 1, for example. The grid electrode 13 also has a function of converging the electrons, which are emitted from the electron emitting portion 9, as the electron beam 11. Without limiting to this embodiment, the grid electrode 13 may be formed of an electrode for extracting the electrons, and an electrode for converging the electrons.

The grid electrode 13 in the electron gun 7 is supported by the cylindrical support member 14, and is configured to control positional accuracy of the electron beam 11 with which to irradiate the target 3. In using the X-ray generating tube 1 according to the present invention, when the cathode heater 10 is turned on, heat radiation from the cathode heater 10 increases temperatures of the surrounding grid electrode 13 and support member 14, and when the cathode heater 10 is turned off, the temperatures are decreased. Therefore, with the cathode heater 10 being driven to be turned on and off, thermal stress resulting from a difference in coefficient of thermal expansion between the grid electrode 13 and the support member 14 acts repeatedly on a joining portion between the grid electrode 13 and the support member 14. When the grid electrode 13 and the support member 14 are directly joined to each other, and thermal stress applied to the joining portion is high, problems, such as the joining portion is disconnected, may occur.

In the present invention, the grid electrode 13 and the support member 14 are joined to each other via a buffer member 17, which has an elastic coefficient that is lower than each elastic coefficient of the grid electrode 13 and the support member 14, a first joining portion 16, and a second joining portion 19. The first joining portion is a joining portion between the grid electrode 13 and the buffer member 17, and the second joining portion 19 is a joining portion between the support member 14 and the buffer member 17. In other words, the grid electrode and the buffer member are joined to each other to form a first joining portion, while the support member and the buffer member are joined to each other to form a second joining portion. Thus, in the present invention, the grid electrode and the support member are secured to each other via the first joining portion and the second joining portion. Therefore, a part of the thermal stress applied to the joining portion between the grid electrode 13 and the support member 14 is absorbed by deformation of the buffer member 17 having the low elastic coefficient. Moreover, thermal stress that is left without being absorbed by the buffer member 17 is dispersed to the first joining portion 16 on the grid electrode side of the buffer member 17, and to the second joining portion 19 on the support member side. Therefore, thermal stress applied to each of the first joining portion 16 and the second joining portion 19 is lower than thermal stress applied to a joining portion obtained when the grid electrode 13 and the support member 14 are directly joined to each other, with the result that damage to the first joining portion 16 and the second joining portion 19 is suppressed.

The buffer member 17 used in the present invention has the elastic coefficient that is lower than the elastic coefficients of the grid electrode 13 and the support member 14. A normal operating temperature range of the X-ray generating tube 1 is a temperature range of from ambient temperature (27° C.) to 200° C. In order that the elastic coefficient of the buffer member 17 maintain a value that is lower than the elastic coefficients of the grid electrode 13 and the support member 14 in this temperature range, it is preferred that the elastic coefficient of the buffer member 17 be 10% or more lower than the elastic coefficients of the grid electrode 13 and the support member 14 at the ambient temperature. Examples of a material that satisfies the relationship among the elastic coefficients include a combination of using kovar as the buffer member 17 and using molybdenum or stainless steel (SUS) as the grid electrode 13 and the support member 14. The elastic coefficients at the ambient temperature (27° C.) are 159 GPa for kovar, 327 GPa for molybdenum, and 200 GPa for SUS.

In reducing the thermal stress applied to each of the first joining portion 16 and the second joining portion 19 to suppress the damage to the joining portions more effectively, it is preferred to set a magnitude relationship among coefficient of thermal expansions of the grid electrode 13, the buffer member 17, and the support member 14. Specifically, it is preferred to set the coefficient of thermal expansions as follows: the grid electrode 13<the buffer member 17<the support member 14, or the grid electrode 13>the buffer member 17>the support member 14.

The X-ray generating tube 1 is increased in temperature when in use. Therefore, thermal stress is generated in the first joining portion 16 and the second joining portion 19 due to a difference ($\Delta\alpha$) in coefficient of thermal expansion between adjacent members at each joining portion, and a strain ($\Delta\varepsilon$) is produced in each member. In a metal material, a permanent set at the time when steel yields is about 0.002 (0.2%), and hence stress that produces the permanent set of 0.2% when the load is removed is called "0.2% offset yield strength", and is used as a substitute for yield strength. When the members are selected so as to satisfy $\Delta\varepsilon=\Delta\alpha\times\Delta T<0.002$ when thermal stress is generated, where $\Delta T$ is a temperature difference generated in the X-ray generating tube 1, the members are used without yielding, and the possibility of damaging the joining portions is low even with repeated application of thermal stress. Assuming that the temperature difference $\Delta T$ is 150° C., from $\Delta\alpha=0.002/150°$ C.$=1.33\times10^{-5}/°$ C., it is preferred that the difference in coefficient of thermal expansions between adjacent members be $1.33\times10^{-5}/°$ C. or less.

Examples of a combination that satisfies the above-mentioned preferred condition of the coefficient of thermal expansions include a combination of using kovar as the buffer member 17, and using SUS and molybdenum as the support member 14 and the grid electrode 13, respectively, or molybdenum and SUS as the support member 14 and the grid electrode 13, respectively. The coefficient of thermal expansions are $5.2\times10^{-6}/°$ C. for molybdenum, $7.0\times10^{-6}/°$ C. for kovar, and $18\times10^{-6}/°$ C. for SUS.

In this example, the first joining portion 16 is a joining portion with a joining member 18 having a solidus temperature that is lower than solidus temperatures of the grid electrode 13 and the buffer member 17. The solidus temperature is measured with a method defined in JIS Z 3198 "Test methods for lead-free solders". At the first joining portion 16, the joining member 18 having the solidus temperature that is lower than the solidus temperatures of the grid electrode 13 and the buffer member 17 may be used to join the grid electrode 13 and the buffer member 17 without melting the grid electrode 13 and the buffer member 17. Therefore, even when the grid electrode 13 is made of a material having a high melting point, the buffer member 17 and the grid electrode 13 may be satisfactorily connected to each other, and a positional shift therebetween may also be suppressed to a small amount.

As the joining member 18, it is preferred to use a brazing filler metal. As the brazing filler metal, a brazing filler metal made of an alloy containing gold, silver, copper, tin, or other such metals may be used, and the brazing filler metal may be selected as appropriate depending on compositions of members to be joined. Brazing with the brazing filler metal is a method involving placing a solid brazing filler metal at an area to be brazed, heating the brazing filler metal to a predetermined temperature to melt the brazing filler metal once, and then allowing the brazing filler metal to reach the ambient temperature again and solidify, to thereby join surfaces of the materials. It is desired that the joining member 18 have a thickness of from 50 μm or more to 500 μm or less, and more preferably, a thickness of from 80 μm or more to 200 μm or less. The joining member 18 is placed between the grid electrode 13 and the buffer member 17 while being in a solid state so as to have desired thickness and area, and is used for joining by being melted under inert atmosphere.

In this example, the grid electrode 13 and the buffer member 17 are first joined to each other via the joining member 18. Then, the grid electrode 13 and the support member 14 are aligned to each other at a positioning portion 15, which is to be described later, and the buffer member 17 and the support member 14 are joined to each other under a state in which the positions are maintained.

In this example, it is preferred that the joining at the second joining portion 19 be performed by welding. As types of welding, TIG welding, spot welding, and laser beam welding are applicable to the present invention, for example. In general, the welding may join members even when there is a gap between the members to be joined. In this example, in order to absorb a thickness error of the joining member 18 of the first joining portion 16, it is preferred that a gap of from 10 μm to 100 μm be formed between the buffer member 17 and the support member 14. Therefore, a height (length in the tube axis direction) of the buffer member 17 may be set so that the above-mentioned gap is formed between the buffer member 17 and the support member 14 under a state in which the grid electrode 13 and the support member 14 are securely in contact with each other at the positioning portion 15.

In this example, there has been described the example in which the first joining portion 16 is the joining portion with the joining member 18, but the second joining portion 19 may be joining with the joining member 18. In this case, as the joining member 18, a material having a solidus temperature that is lower than solidus temperatures of the support member 14 and the buffer member 17 is used. Then, the support member 14 and the buffer member 17 may be joined to each other with the joining member 18. Thereafter, the grid electrode 13 and the support member 14 may be aligned to each other at the positioning portion 15, and the buffer member 17 and the grid electrode 13 may be joined to each other by welding under a state in which the positions are maintained.

The joining member 18 has the solidus temperature that is lower than the members to be joined, and hence it is preferred that the joining member 18 be located farther from a heat source. As illustrated in FIG. 1B, it is preferred that the first joining portion 16, which is located farther from the electron emitting portion 9, be joining with the joining member 18.

In this example, the positioning portion 15, at which the grid electrode 13 and the support member 14 are brought into direct contact with each other, is provided on an inner side of the second joining portion 19 in a direction perpendicular to the tube axis. At the positioning portion 15, an end surface on the cathode side of the grid electrode 13 and an end surface on the anode surface of the support member 14 are brought into contact with each other as positioning surfaces to restrict positional relationship between the grid electrode 13 and the support member 14 in the tube axis direction.

Electrons extracted from the electron emitting portion 9 are converged when passing through the passage hole 13*a* of the grid electrode 13, and a locus of the electrons is controlled. Therefore, accuracy of a position of the electron beam 11 on the target 3 irradiated with the electron beam 11 depends on accuracy of a position at which the grid electrode 13 is mounted to the support member 14. When alignment accuracy in joining the grid electrode 13 to the support member 14 is high, the position of the electron beam 11 on the target 3 irradiated with the electron beam 11 may be controlled with high accuracy. In this example, the grid electrode 13 and the support member 14 are joined to each other under a state in which the positional relationship between the grid electrode 13 and the support member 14 is restricted by the positioning portion 15, with the result that a position of the grid electrode 13 in the tube axis direction may be controlled with high accuracy.

Figure 2A:
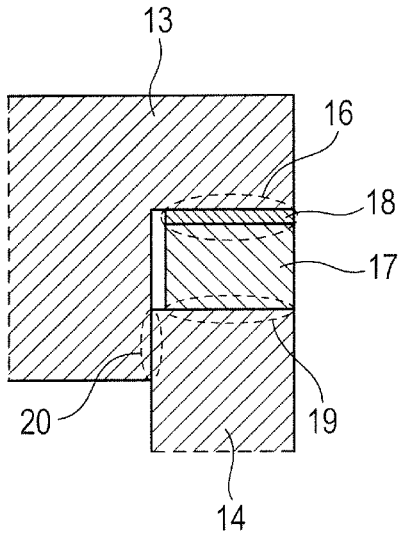
FIG. 2A and FIG. 2B are each a partially enlarged view for schematically illustrating the structure of an X-ray generating tube according to another embodiment of the present invention.
Figure 2B:
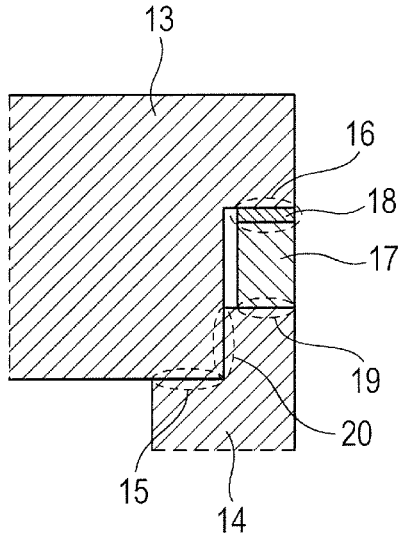

Moreover, in this example, as illustrated in FIG. 1B, the positioning portion 15 is a contact area between the positioning surfaces facing the tube axis direction of the grid electrode 13 and the support member 14, but the positioning surfaces may be surfaces facing the direction perpendicular to the tube axis. In FIG. 2A, there is illustrated a mode including a positioning portion 20, which is a contact area between the positioning surfaces facing the direction perpendicular to the tube axis, and the position at which the grid electrode 13 is mounted to the support member 14 is restricted in the direction perpendicular to the tube axis. Further, as the positioning surfaces, the positioning surfaces facing the tube axis direction may be provided together with positioning surfaces facing the direction perpendicular to the tube axis to restrict the position at which the grid electrode 13 is mounted to the support member 14 in both directions. In FIG. 2B, there is illustrated a structure example in which a step is formed on an inner circumferential side of an end portion on the anode side of the support member 14 to provide the positioning portion 15 configured to restrict the position at which the grid electrode 13 is mounted in the tube axis direction, and the positioning portion 20 configured to restrict the position in the direction perpendicular to the tube axis.

As described above with reference to FIG. 1B, FIG. 2A, and FIG. 2B, the positioning portions 15 and 20 are configured to restrict the position at which the grid electrode 13 is mounted to the support member 14 in the tube axis direction or the direction perpendicular to the tube axis. However, in the present invention, there may be provided a positioning portion configured to restrict the position at which the grid electrode 13 is mounted in a direction inclined to the tube axis.

Figure 3A:
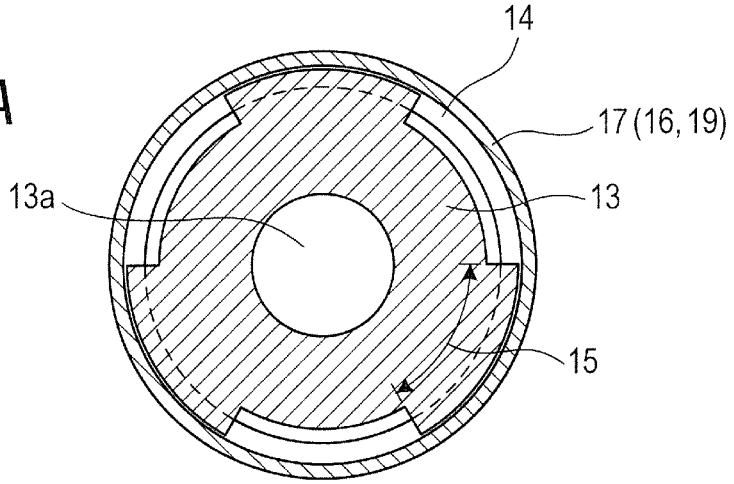
FIG. 3A, FIG. 3B, and FIG. 3C are each a cross-sectional view for schematically illustrating another structure of an X-ray generating tube according to an embodiment of the present invention.
Figure 3B:
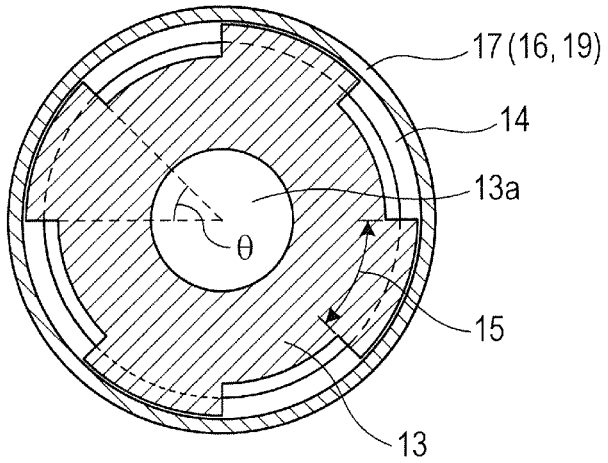
Figure 3C:
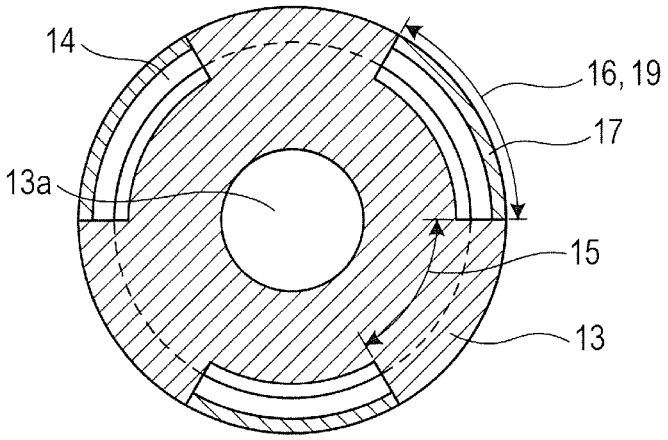

The positioning portion 15 may be provided in a continuous annular shape in a circumferential direction with the tube axis being the center, but a plurality of positioning portions 15 may be provided separately in the circumferential direction. When the plurality of positioning portions 15 are provided separately, it is preferred to provide three or more positioning portions 15, and desirably, three positioning portions 15 for stable positioning. In FIG. 3A, there is illustrated an example in which three positioning portions 15 are located in the circumferential direction, and in FIG. 3B, there is illustrated an example in which four positioning portions 15 are located in the circumferential direction. The first joining portion 16 and the second joining portion 19 in FIG. 3A and FIG. 3B are provided in the continuous annular shape so that joining portion strength may be easily obtained, but a plurality of first joining portions 16 and second joining portions 19 may be provided separately in the circumferential direction with the tube axis being the center as long as sufficient joining portion strength is obtained. Moreover, in all of the examples illustrated in FIG. 1A, FIG. 1B, and FIG. 3A to FIG. 3C, the first joining portion 16 and the second joining portion 19 are arranged to be shifted from the positioning portion 15 in the direction perpendicular to the tube axis. In this case, in order to facilitate joining, the first joining portion 16 and the second joining portion 19 are arranged on an outer circumferential side with the tube axis being the center. Moreover, the first joining portion 16 and the second joining portion 19 may be arranged to be shifted from the positioning portion 15 in the circumferential direction with the tube axis being the center. In other words, when seen from the tube axis direction, the positioning portion 15, the first joining portion 16, and the second joining portion 19 may be arranged so that the positioning portion 15 and the first joining portion 16 have non-overlapping portions, and so that the positioning portion 15 and the second joining portion 19 have non-overlapping portions. FIG. 3C is a cross-sectional schematic view for illustrating an example in which the first joining portion 16 and the second joining portion 19 are arranged in a staggered manner with respect to the positioning portion 15 in the circumferential direction with the tube axis being the center. FIG. 3A to FIG. 3C are cross-sectional schematic views in the direction perpendicular to the tube axis, and are cross-sectional views at a position corresponding to the line B-B' in FIG. 1B.

Figure 4:
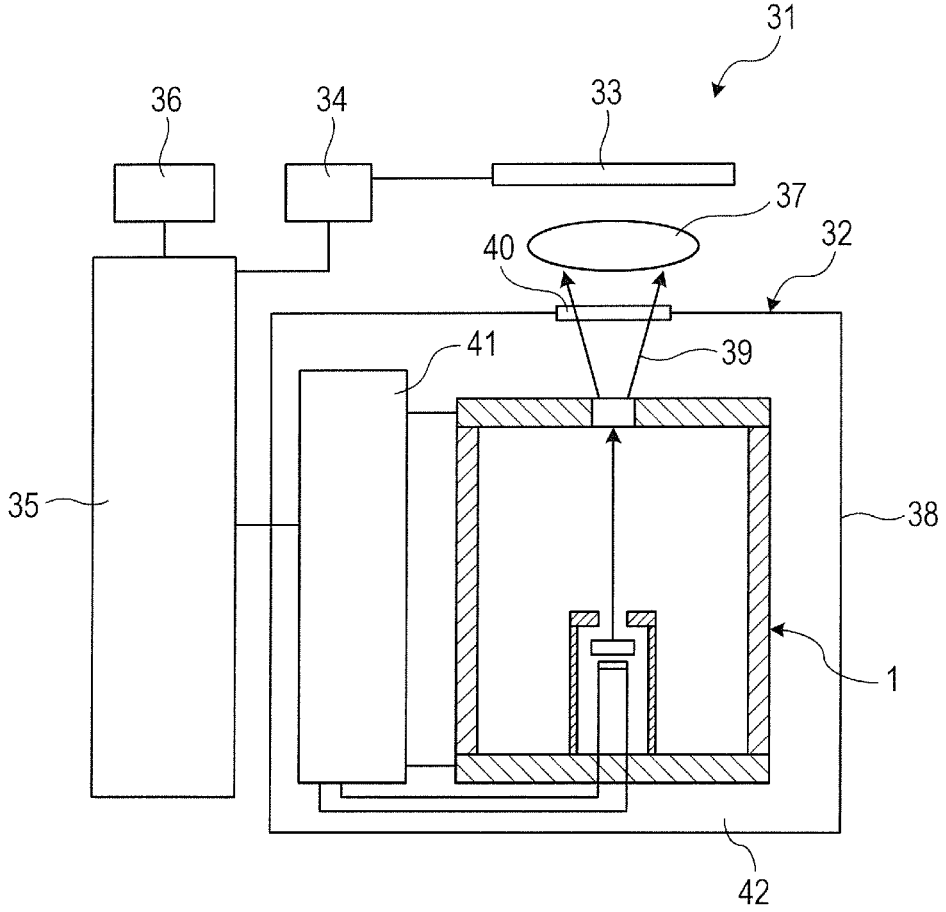
FIG. 4 is a diagram for schematically illustrating the structure of a radiography system according to an embodiment of the present invention.

In FIG. 4, there is illustrated an X-ray generating apparatus 32 and a radiography system 31 according an embodiment of the present invention, which use the X-ray generating tube 1 according to the present invention. The X-ray generating apparatus 32 includes the X-ray generating tube 1 and a tube voltage circuit 41, which is configured to drive the X-ray generating tube 1, in a container 38 having an X-ray transmissive window 40. A tube voltage is applied between the cathode 6, which includes the electron emitting portion 9, and the anode 2 of the X-ray generating tube 1 by the tube voltage circuit 41, and an electric field is formed between the target 3 and the electron emitting portion 9. At this time, a predetermined voltage is applied to the grid electrode 13 by the tube voltage circuit 41 to irradiate the target 3 with the electrons. A required type of an X-ray 39 may be selected by appropriately setting the tube voltage depending on a film thickness and a type of the metal of the target layer (not shown) of the target 3.

It is desired that the container 38 containing the X-ray generating tube 1 and the tube voltage circuit 41 have sufficient strength as a container, and be excellent in heat radiation property. A metal material, such as brass, iron, or stainless steel may be used as a component of the container 38. An insulating liquid 42 is filled in a remaining space other than the X-ray generating tube 1 and the tube voltage circuit 41 in the container 38. The insulating liquid 42 is a liquid having an electrical insulating property, and has a role of maintaining an electrical insulating property inside the container 38 and a role of a cooling medium of the X-ray generating tube 1. As the insulating liquid 42, it is preferred to use electrical insulating oil, such as mineral oil, silicone oil, or perfluoro oil.

The radiography system 31 according to the present invention includes, as illustrated in FIG. 4, the X-ray generating apparatus 32, an X-ray detector 33, a signal processing unit 34, a system control unit 35, and a display unit 36. The radiography system 31 may take a radiographic image by irradiating an object 37 with an X-ray beam 39 from the X-ray generating apparatus 32 through the X-ray transmissive window 40. In the radiography system 31 of FIG. 4, support columns (not shown) configured to support the constituent members in the radiography system 31, and an insulating member (not shown) configured to provide an electrical insulating performance are arranged as appropriate.

The system control unit 35 is configured to control the irradiation with the X-ray by actuating the X-ray generating apparatus 32 through the tube voltage circuit 41, and to process a signal from the X-ray detector 33 through the signal processing unit 34. In other words, the system control unit 35 is configured to control the X-ray generating apparatus 32 and the X-ray detector 33 in conjunction. The X-ray emitted from the X-ray generating apparatus 32 is detected by the X-ray detector 33 via the object 37 so that an X-ray transmission image of the object 37 is taken. The obtained X-ray transmission image is displayed on the display unit 36. Moreover, in driving the X-ray generating apparatus 32, the system control unit 35 may control a voltage signal applied to the X-ray generating tube 1 through the tube voltage circuit 41 to set an appropriate imaging condition.

EXAMPLES

Example 1

The electron gun 7 having the structure illustrated in FIG. 1A and FIG. 1B was produced. In the electron gun 7, a tungsten heater was used as the cathode heater 10, and ring-shaped molybdenum having an aperture was used as the grid electrode 13. Moreover, an impregnated electron source, which was obtained by impregnating a tungsten sintered body with barium was used as the electron emitting portion 9, SUS 304 was used as the support member 14, and kovar was used as the buffer member 17. First, the buffer member 17 was joined to the grid electrode 13 using a silver brazing filler metal (BAg-8: JIS Z 3261) as the joining member 18 under a condition in which a brazing temperature was 850° C. Next, the electron emitting portion 9 was mounted to the grid electrode 13 through a member (not shown), and then the grid electrode 13 was joined to the support member 14.

In joining at the second joining portion 19, the grid electrode 13 and the support member 14 were aligned to each other at the annular positioning portion 15 with the tube axis being the center, and then a boundary portion between the buffer member 17 and the support member 14 was laser-beam welded from the outer circumference. At this time, a gap between the buffer member 17 and the support member 14 was 50 μm. It was confirmed that the joining portion position between the grid electrode 13 and the support member 14 of the electron gun 7 produced as described above had no shift or inclination, and that the grid electrode 13 and the support member 14 were firmly joined to each other.

Next, the X-ray generating tube 1 equipped with the electron gun 7 was produced. In the X-ray generating tube 1, kovar was used as the anode member 4 and the cathode member 8, alumina ceramic was used as the insulating tube 5, and a tungsten film was formed as a target film (not shown) of the target 3.

Finally, the radiography system 31 of FIG. 4 including the X-ray generating tube 1 was produced, and an X-ray imaging experiment was performed with an electron acceleration voltage being set to 100 kV. In X-ray imaging, after it was confirmed that the position of the electron beam 11 on the target 3 irradiated with the electron beam 11 was appropriate, the tungsten heater was repeatedly turned on and off for 100 sets. As a result, an image taken through the X-ray imaging experiment was satisfactory, and there was no variation in position of the electron beam 11 on the target 3 irradiated with the electron beam 11.

Example 2

The X-ray generating tube 1 having the structure similar to Example 1 was produced except that the grid electrode 13 was made of SUS 304, the support member 14 was made of molybdenum, and the joining member 18 was arranged between the buffer member 17 and the support member 14. In this example, first, the buffer member 17 was joined to the support member 14 through the joining member 18. Thereafter, the grid electrode 13 and the support member 14 were aligned to each other at the positioning portion 15, and then the buffer member 17 was joined to the grid electrode 13 by welding.

Also in this example, it was confirmed that the joining portion position between the grid electrode 13 and the support member 14 of the produced electron gun 7 had no shift or inclination, and that the grid electrode 13 and the support member 14 were firmly joined to each other. Further, when an X-ray imaging experiment similar to that in Example 1 was performed, the taken image was satisfactory, and there was no variation in irradiation position of the electron beam 11 on the target 3. In this Example, the support member 14 made of a molybdenum material, which has a high elastic coefficient, is arranged at a position close to the cathode member 8, and hence the electron gun 7 has high rigidity. Therefore, even when oscillation is externally applied to the radiography system 31, oscillation of the electron gun 7 is suppressed to cause no fluctuation in the electron beam 11, and there is obtained the effect of reducing a variation in position of the electron beam 11 with which to irradiate the target 3.

Example 3

The X-ray generating tube 1 was produced similarly to Example 1 except that a shape of the end surface on the cathode side of the grid electrode 13 was changed to the shape illustrated in FIG. 3B so that four positioning portions 15 were provided in the circumferential direction with the tube axis being the center. The four positioning portions 15 were provided at a pitch of 90° in the circumferential direction with θ being 45°. Between positioning portions 15, 15 adjacent to each other in the circumferential direction, a distance between the grid electrode 13 and the support member 14 was 100 μm.

Also in this example, it was confirmed that the joining portion position between the grid electrode 13 and the support member 14 of the produced electron gun 7 had no shift or inclination, and that the grid electrode 13 and the support member 14 were firmly joined to each other. Further, when an X-ray imaging experiment similar to that in Example 1 was performed, the taken image was satisfactory, and there was no variation in irradiation position of the electron beam 11 on the target 3.

In the present invention, similar effects are obtained even when there are portions at which members are substantially in contact with each other and portions at which members are not in contact with each other at the annular positioning portion 15 with the tube axis being the center due to accuracy of finishing the members.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-067013, filed Mar. 30, 2016, which is hereby incorporated by reference herein in its entirety.

What is claimed is:

1. An X-ray generating tube including an electron gun, the electron gun comprising:

a grid electrode;

a support member configured to support the grid electrode; and a buffer member having an elastic coefficient that is lower than each elastic coefficient of the grid electrode and the support member, wherein the grid electrode and the buffer member are joined to each other to form a first joining portion, and the support member and the buffer member are joined to each other to form a second joining portion, and wherein the grid electrode and the support member are secured to each other via the first joining portion and the second joining portion.

2. The X-ray generating tube according to claim 1, wherein the buffer member has an elastic coefficient that is 10% or more lower than each elastic coefficient of the grid electrode and the support member at ambient temperature.

3. The X-ray generating tube according to claim 1, wherein each one of the grid electrode, the buffer member, and the support member has a unique coefficient of thermal expansion which meets the following set of relationships: the support member>the buffer member>the grid electrode; and the grid electrode>the buffer member>the support member.

4. The X-ray generating tube according to claim 3, wherein the buffer member and each of the grid electrode and the support member have a difference in coefficient of thermal expansion of $1.33\times10^{-5}$/° C. or less.

5. The X-ray generating tube according to claim 1, further comprising a positioning portion, which comprises a contact area between positioning surfaces of the grid electrode and the support member, and is configured to restrict a positional relationship between the grid electrode and the support member.

6. The X-ray generating tube according to claim 5, wherein the positioning portion comprises a contact area between positioning surfaces facing a tube axis direction of the X-ray generating tube.

7. The X-ray generating tube according to claim 5, wherein the positioning portion comprises a contact area between positioning surfaces facing a direction perpendicular to a tube axis direction of the X-ray generating tube.

8. The X-ray generating tube according to claim 6, wherein the positioning portion comprises an area including both the contact area between the positioning surfaces facing the tube axis direction of the X-ray generating tube, and a contact area between positioning surfaces facing a direction perpendicular to the tube axis direction of the X-ray generating tube.

9. The X-ray generating tube according to claim 5, wherein the positioning portion comprises positioning portions located separately in a circumferential direction with a tube axis of the X-ray generating tube being a center.

10. The X-ray generating tube according to claim 9, wherein the positioning portion comprises three positioning portions located in the circumferential direction with the tube axis of the X-ray generating tube being the center.

11. The X-ray generating tube according to claim 5, wherein, when the positioning portion, the first joining portion, and the second joining portion are seen from a tube axis direction of the X-ray generating tube, the positioning portion and the first joining portion have non-overlapping portions, and the positioning portion and the second joining portion have non-overlapping portions.

12. The X-ray generating tube according to claim 5, wherein the second joining portion is located on an outer circumferential side of the positioning portion with a tube axis of the X-ray generating tube being a center.

13. The X-ray generating tube according to claim 1, wherein the first joining portion comprises a joining portion with a joining member having a solidus temperature that is lower than solidus temperatures of the grid electrode and the buffer member.

14. The X-ray generating tube according to claim 13, wherein the joining member comprises a brazing filler metal.

15. The X-ray generating tube according to claim 1, wherein the second joining portion comprises a welded portion.

16. The X-ray generating tube according to claim 15, wherein the second joining portion has a gap formed between the buffer member and the support member.

17. The X-ray generating tube according to claim 1, further comprising an anode having a target configured to generate an X-ray in response to electron irradiation and a cathode, wherein the cathode includes the electron gun, and wherein the target and the electron gun are arranged to be opposed to each other.

18. An X-ray generating apparatus, comprising:

the X-ray generating tube according to claim 17; and a tube voltage circuit configured to apply a tube voltage between the anode and the cathode.

19. An X-ray generating apparatus according to claim 18, further comprising:

a container configured to contain the X-ray generating tube and the tube voltage circuit; and an insulating liquid, which is filled between the container and the X-ray generating tube.

20. A radiography system, comprising:

the X-ray generating apparatus according to claim 18;

an X-ray detector configured to detect a transmission X-ray that has transmitted through a subject to be inspected; and a system control unit configured to control the X-ray generating apparatus and the X-ray detector in conjunction.

* * * * *